US006979481B2

(12) United States Patent
Gaynor et al.

(10) Patent No.: US 6,979,481 B2
(45) Date of Patent: Dec. 27, 2005

(54) MICROPOROUS PHOTO GLOSSY INKJET RECORDING MEDIA

(75) Inventors: Gavin L. Gaynor, Saratoga Springs, NY (US); Larry G. Venable, Cohoes, NY (US)

(73) Assignee: Mohawk Paper Mills, Inc., Cohoes, NY (US)

( * ) Notice: Subject to any disclaimer, the term of this patent is extended or adjusted under 35 U.S.C. 154(b) by 147 days.

(21) Appl. No.: 10/224,241

(22) Filed: Aug. 19, 2002

(65) Prior Publication Data

US 2004/0033323 A1 Feb. 19, 2004

(51) Int. Cl.[7] ..... B41M 5/40

(52) U.S. Cl. ..... 428/32.27; 428/32.26; 428/32.35; 428/32.38

(58) Field of Search ..... 428/32.25, 32.26, 428/32.27, 32.35, 32.38

(56) References Cited

U.S. PATENT DOCUMENTS

| | | | | |
|---|---|---|---|---|
| 4,446,174 | A | 5/1984 | Maekawa et al. | 427/261 |
| 5,171,626 | A | 12/1992 | Nagamine et al. | 428/212 |
| 5,206,071 | A | 4/1993 | Atherton et al. | 428/195 |
| 5,264,275 | A | 11/1993 | Misuda et al. | 428/304.4 |
| 5,576,088 | A | 11/1996 | Ogawa et al. | 428/327 |
| 5,679,451 | A | 10/1997 | Kondo et al. | 428/304.4 |
| 5,707,716 | A | 1/1998 | Yoshino et al. | 428/212 |
| 5,738,932 | A | 4/1998 | Kondo et al. | 428/195 |
| 5,750,200 | A | 5/1998 | Ogawa et al. | 427/361 |
| 5,804,320 | A | 9/1998 | Tomioka et al. | 428/478.2 |
| 5,888,635 | A | 3/1999 | Yang et al. | 428/212 |
| 5,911,855 | A | 6/1999 | Dransmann et al. | 162/135 |
| 5,955,142 | A | 9/1999 | Yoshino et al. | 427/205 |
| 5,955,185 | A | 9/1999 | Yoshino et al. | 428/304.4 |
| 6,194,077 | B1 | 2/2001 | Yuan et al. | 428/478.2 |

FOREIGN PATENT DOCUMENTS

| | | | |
|---|---|---|---|
| WO | 0145956 | 6/2001 | B41M/5/00 |

*Primary Examiner*—B. Shewareged
(74) *Attorney, Agent, or Firm*—White & Case LLP

(57) ABSTRACT

The present invention provides microporous photo quality glossy inkjet receiving media comprising a substrate, an absorbent basecoat layer, and an ink-receptive topcoat. The absorbent basecoat layer is primarily a combination of pigment and binder, and may include deformable particles, such as core-shell polymeric pigments. The ink-receptive topcoat is composed primarily of alumina hydrate, gelatin, and a water-insoluble cationic polymer. The present invention also provides a method for increasing the gloss and surface smoothness presented by the topcoat of a printing medium by including deformable particles in an underlying basecoat followed by calendering of the printing medium. Further, the present invention provides combination matte and gloss inkjet printing media, comprising matte basecoats at least partially coated with the aforementioned ink-receptive topcoat.

46 Claims, 1 Drawing Sheet

MICROPOROUS PHOTO GLOSSY INKJET RECORDING MEDIA

FIELD OF THE INVENTION

The invention relates to the field of inkjet printing media.

BACKGROUND

The most common construction for photo glossy inkjet receivers is based on polymeric (i.e., resin-type) coatings rather than microporous coatings. In such designs, the polymeric receiver swells to absorb the ink solvent (vehicle), and the inkjet dyes are fixed by cationic sites on the binder or receiving layer additives. While these resin-coated receivers offer many advantages, they also have some common shortcomings, including slow dry times, tackiness under high humidity conditions, and coating solubility or softening when exposed to water. Polyvinyl alcohol ("PVOH"; sometimes called "PVA"), poly (vinylpyrrolidone) ("PVP"), and gelatin are among the most common water-soluble polymers used in their construction. Among these polymers, gelatin is of particular interest in the present invention. Gelatin, also known as collagen, is a unique natural polymeric material containing hydroxyl, carboxyl, and amine functional groups. Gelatin exhibits good absorption of water and alcohols commonly used as ink solvents (e.g. ethylene glycol), forms a clear film, has cationic sites for dye fixation, and provides good light-fastness. Additionally, the carboxyl groups provide ample sites for cross-linking with other materials and are reported to provide a buffering action against acidity induced tonal distortions.

Glossy inkjet media based on microporous coatings eliminate or reduce many of the shortcomings of the polymeric coated media with regard to dry time, tackiness, and water sensitivity. However, many suffer from significantly poorer performance in light-fastness and ozone-fastness, and generally have lower gloss and ink density compared to resin coated media. The use of alumina hydrate in microporous inkjet receptive coatings is fairly well known in the art. Early development of pigment based, or microporous, inkjet media focused on silica as the primary pigment. However, alumina hydrate possesses a positive (cationic) surface charge capable of complexing anionic inkjet dyes, in addition to the physical characteristics that make silica so attractive. This combination of properties makes alumina hydrate particularly well-suited among pigments for high quality inkjet applications.

Prior art coatings that use alumina hydrate out of necessity, or at least as a preferred component, rely primarily on PVOH or PVP as a binder. Gelatin and alumina hydrate, particularly alumina hydrate of the boehmite structure, have limited compatibility. The following prior art patents illustrate the limitations in combining alumina hydrate and gelatin in an inkjet coating formulation. U.S. Pat. No. 5,911,855 describes a printing material comprising a support, a dye receiving coating, and an upper coating layer. Gelatin is the primary component of the dye-receiving layer, but this layer is distinct from the porous upper layer, which is composed of boehmite and other water-soluble polymers.

U.S. Pat. No. 5,804,320 discloses a recording medium comprised of an ink-receiving layer composed of a pigment, particularly alumina hydrate, and a heat treated alkali processed gelatin that does not gel at room temperature and which has a weight averaged molecular weight (MW) in the range of 50,000–150,000. The described coating dispersion maintains stable viscosity, but low coating solids are required owing to the high molecular weight of the gelatin.

U.S. Pat. No. 5,738,932 discloses an inkjet recording medium composed of an alumina hydrate and an acid-processed gelatin with MW in the range of 20,000–200,000 or alkali-processed gelatin with MW in the range of 5,000 to 100,000. The gel forming ability of the gelatin and thixotropic nature of the alumina sol are exploited to achieve high coat weight without sagging in a single pass. Even at the lower end of the stated molecular weight ranges, one would expect relatively high viscosity at low coating solids. Owing to the low solids of coatings so constructed (e.g. less than 15% for all examples), preferred coating application methods include kiss coating, extrusion coating, slide coating, and curtain coating. While high-speed coating operations such as blade coating, roll coating, and gravure coating are mentioned as possible coating application methods, one would expect that several coating applications would be necessary to achieve an effective coating thickness.

As further background for the present invention, U.S. Pat. No. 6,194,077 discloses a resin-type, water-fast, ink-receptive material composed of gelatin having a Bloom value of 100 to 300, a water-insoluble quaternary cationic polymer, and a multifunctional cross-linker.

SUMMARY OF THE INVENTION

One objective of the current invention is to provide a high quality microporous glossy inkjet printable media at an economical price. Extensive laboratory, pilot, and manufacturing studies aimed toward this objective have resulted in the following:

1) A microporous ink-receptive coating which combines the positive attributes of alumina hydrate and gelatin in a coating formulation that can be made and applied at high solids, and has exceptional dye affinity;
2) An inventive absorbent basecoat formulation that utilizes deformable pigments to improve the gloss, smoothness, and distinctiveness of image, upon calendaring the finished product; and can be made and applied at high solids; and
3) An inventive method for combining a matte-finish inkjet coating as a basecoat, with a microporous ink-receptive topcoat to produce a media having a matte-finish inkjet printable surface on one side and a glossy-finish inkjet printable surface on the other.

Accordingly, the invention provides an inkjet recording medium comprising a microporous ink-receptive layer containing alumina hydrate and ultra-low molecular weight gelatin.

The invention further provides an inkjet recording medium comprising a microporous ink-receptive layer containing alumina hydrate and ultra-low molecular weight gelatin, and optionally at least one co-binder. The co-binder may be water-insoluble. Further, the co-binder may be cationic. Thus, a cationic water-insoluble co-binder may be used.

The invention further provides an inkjet recording medium comprising a microporous ink-receptive layer containing alumina hydrate and ultra-low molecular weight gelatin, and at least one underlying coating layer.

The invention further provides an inkjet recording medium comprising a microporous ink-receptive layer containing alumina hydrate and ultra-low molecular weight gelatin, and at least one underlying layer comprising deformable particles. The deformable particles can have substantial internal void volume. Further, the deformable particles may have a substantially adhesive outer surface. Thus, hollow core-shell polymeric pigments having an adhesive outer shell may also be used.

The invention provides a gloss promoting absorbent basecoat comprising: binder; absorbent pigment in an amount from more-than-zero to less-than-100 parts based on 100 parts total pigment by dry weight in the basecoat formulation; deformable pigment in an amount of more-than-zero to 50 parts based on 100 parts total pigment by dry weight in the basecoat formulation; and conventional paper coating pigments in amount of 0 to 80 parts based on 100 parts total pigment by dry weight in the basecoat formulation The deformable particles can have substantial internal void volume. Further, the deformable particles may have a substantially adhesive outer surface. Thus, hollow core-shell polymeric pigments having an adhesive outer shell may be used.

The invention also provides glossy microporous ink-receptive coating layer formulations, comprising an alumina hydrate based particle pigment selected from the group consisting of alumina hydrate pigment particles, alumina hydrate enriched silica particles, or other alumina hydrate surface-enriched particles and mixtures thereof; acid-processed gelatin having a weight averaged molecular weight not greater than about 12,000 or alkali-processed gelatin having a weight averaged molecular weight of not greater than about 5,000; and optionally a co-binder, which may be a water-insoluble cationic polymer. The alumina hydrate or alumina hydrate enriched particles may have a BET surface area in the range of about 100 to about 260 $m^2/g$, a pore volume in the range of about 0.1 to 1.1 ml/g, and a dispersed particle size in the range of about 25 to about 300 nm.

A printing medium of superior gloss, smoothness, and inkjet print quality is obtained by the combination, in the same printing medium, of the basecoat and topcoat formulations described above.

The invention also provides a general method for increasing the specular gloss, smoothness, and distinctness of image of a double-coated printing medium, while minimizing the reduction in porosity of the topcoat as a result of calendaring, which comprises the steps of (a) applying a layer of paper coating formulation to an uncoated substrate or to a previously coated substrate, wherein the paper coating formulation comprises deformable particles; (b) applying a topcoat layer of paper coating formulation above the layer applied in step (a); and (c) calendering the paper. The deformable particles may further be adhesive, such that the binder level of the coating used in step (a) may be reduced to also increase its porosity.

The inventors have also discovered that the printing medium comprising the above described glossy microporous ink-receptive layer formulation coated over more-porous, matte-finish inkjet printable coatings results in a high quality, inkjet printable surface having only slightly reduced gloss, compared to the printing medium utilizing the optimal gloss basecoat formulations described above. Hence, the invention further provides an inkjet printing medium comprising a substrate having two sides; a porous, matte-finish, inkjet printable coating coated on at least one side of the substrate; and the glossy microporous ink-receptive layer formulation coated over at least a portion of the porous, matte-finish inkjet printable coating on at least one of the sides on which the porous, matte-finish, inkjet printable coating is coated.

In a related embodiment, the invention provides an inkjet printing medium comprising a substrate; a porous, matte-finish, inkjet printable coating coated on both sides of the substrate; and the glossy topcoat layer formulation over the porous, matte-finish inkjet printable coating on only one of the sides on which the porous, matte-finish, inkjet printable coating is coated, so that one side of the inkjet printing medium has an inkjet printable matte-finish surface and the other side of the inkjet printing medium has an inkjet printable glossy-finish surface.

The invention still further provides specific matte-finish, inkjet-printable coating formulations suitable for producing commercial matte inkjet products and use as a basesheet layer in the gloss-over-matte embodiments of the invention.

DETAILED DESCRIPTION

Figure 1:
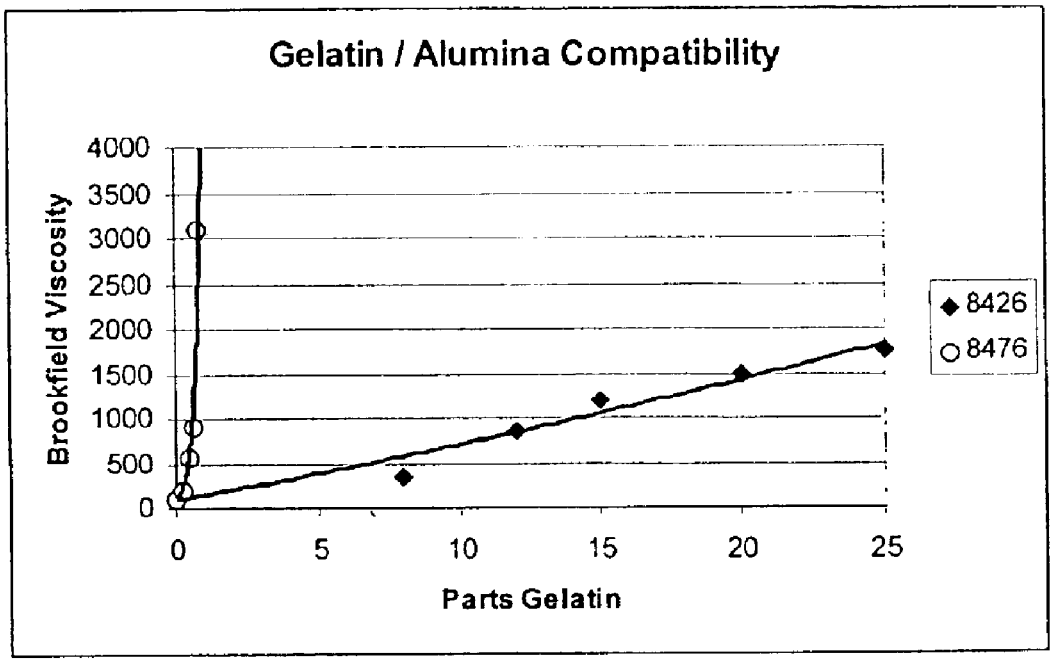
FIG. 1 illustrates the effect of gelatin molecular weight on viscosity for an alumina/gelatin system at 41.7 percent solids and 75 degrees F.

The invention comprises two basic inkjet print media embodiments, a high-gloss embodiment and a comparatively reduced gloss-over-matte finish embodiment sharing a common ink receptive coating formulation; three coating formulations, a microporous ink receptive coating, a gloss-promoting absorbent basecoat, and a matte-finish inkjet coating formulation suitable for the gloss-over-matte embodiment; a method for improving the gloss, smoothness, and distinctness of image of a double coated media; and a method for producing media having both matte- and glossy-finish inkjet printable surfaces.

High-Gloss Printing Media Of The Invention

According to the invention, gelatin of ultra-low molecular weight ("ULMW gelatin") is compatible with alumina hydrate, including the boehmite form of alumina hydrate. ULMW gelatin may be obtained by hydrolyzing standard gelatin. Any other physical or chemical process for obtaining ULMW gelatin may also be used. The ULMW gelatin has no gelation tendency at room temperature and can be made up at high solids (e.g.—up to 50%). These properties make possible high solids ink-receptive coating composed of alumina hydrate and gelatin, which has no extraordinary viscosity dependence on temperature, and is amenable to application by high speed coating equipment. Any tendency for cracking which is associated with ULMW gelatin may be overcome by cross-linking of the gelatin with itself and/or cross-linking or physical entanglement with a co-binder. In one embodiment, the co-binder is a water-insoluble cationic polymer. The result is a glossy inkjet-receiving layer of exceptional print quality, with instant dry times, wet and dry surface durability, and good water-fastness, that can be manufactured via high-speed coating operations.

The present inventors have also discovered that including deformable particles in an underlying layer of coating formulation can be used to adjust calenderability, so that increased specular gloss, smoothness, and distinctness of image may be presented by an overlying topcoat layer, while minimizing the effect of calendering on the topcoat porosity. For example, a hollow-sphere plastic pigment can be used to adjust calenderability, i.e., glossing tendency, and coating porosity, in this manner. In conventional paper coatings, deformable particles (plastic pigment) are commonly used to enhance gloss by placing the deformable particles in the outermost layer, i.e., the topcoat layer. In contrast, according to the present invention, the deformable particles are located in a layer below the topcoat layer of the printing medium.

For example, the deformable particles can be present in the absorbent basecoat layer of a two-layer, i.e., basecoat and topcoat, construction. The deformable particles provide additional gloss and surface smoothness upon calendering, even when the topcoat layer is applied prior to calendering.

While the addition of deformable particles to an underlying layer does not have the same impact on gloss improvement as would be achieved with a similar amount in the topcoat, gloss improvement can be advantageously achieved without reducing the porosity of the topcoat. Further, the increase in opacity, or decrease in transparency, that is typically encountered with the addition of deformable particles (plastic pigment) is confined to the underlying layer, rather than in the topcoat layer where it will have a negative impact on ink density.

The inventors have further discovered yet another advantage that is obtained when the deformable particles used have an adhesive outer surface. Such a particle may be, for example, a core-shell polymeric pigment, with a deformable core and a shell of substantial adhesiveness. As described above, use of the deformable Particles in a layer underlying the topcoat layer can be used to adjust calenderability, i.e., glossing tendency, while maintaining topcoat porosity. Advantageously, the inclusion of deformable particles with an adhesive surface may allow a reduction in binder level of the basecoat that can more than offset the reduction in basecoat porosity due to the presence of deformable particles upon calendering. Further, the enhanced porosity can be exploited by increasing the ratio of less porous "conventional paper coating pigments" to "absorbent pigments". This modification in turn allows higher coating solids, and most often a reduction in material cost. The result is a relatively low-cost absorbent basecoat which promotes gloss, enhances porosity of the topcoat layer at a given gloss level, and can be easily applied with high-speed coating equipment.

The combination of the absorbent basecoat and glossy ink-receiving topcoat, as described above, provide an economical microporous glossy inkjet media capable of inkjet print quality near that of conventional photographic prints.

The present invention provides a microporous glossy inkjet recording medium composed of a substrate, an absorbent basecoat layer, and an ink-receptive topcoat. The functional coatings can be applied to one or both sides of a substrate to provide a one-side coated ("C1S") or two-sides coated ("C2S") recording medium, respectively.

Suitable substrates include a variety of materials commonly used as inkjet substrates. In one embodiment of the invention, the substrate is a paper based substrate material as known in the art. Optionally, the substrate can be treated on the side opposite the ink-receptive layer, in the case of a C1S substrate or a C2S substrate with one usable side, to provide further structural integrity (e.g., enhanced resistance to cockle and curl), enhanced printability (e.g. inkjet, laser, offset, etc.), or means of attachment (e.g. adhesive, magnetic, etc.).

The absorbent basecoat layer is designed to provide sufficient absorption capacity and absorption rate of the ink vehicle, while enhancing the gloss of the final product. The basecoat is primarily a combination of pigment and binder. Absorbent inorganic pigment(s) is used to provide sufficient absorption capacity and absorption rate. Suitable absorbent pigments include, but are not limited to, metal oxides (e.g. silicas, aluminas, zinc oxide, etc.), and natural and synthetic silicates (e.g. calcium silicate, calcined clays, modified clays, hydrotalcite, zeolites, etc.). According to the invention, the absorbent pigment is present in an amount from greater-than-zero to 100 parts, per 100 parts total pigment in the basecoat formulation, measured by dry weight. In one embodiment of the invention, the absorbent pigment is present in an amount from 20 to 100 parts, per 100 parts total pigment in the basecoat. In another embodiment of the invention, the absorbent pigment is present in an amount from 30 to 50 parts, per 100 parts total pigment in the basecoat.

A still further embodiment of the invention provides that the basecoat includes at least one deformable pigment. Particularly suitable is a hollow core-shell polymeric pigment having a deformable core and a shell of substantial adhesive strength. Using this core-shell polymeric pigment, binder level can be reduced. The result is that gloss and smoothness can be enhanced while also increasing porosity, with no negative impact on coating integrity. The polymeric pigment is present in an amount of from 0 to 50 parts, based on 100 parts total pigment in the basecoat. In one embodiment of the invention, the polymeric pigment is present in an amount of from 5 to 15 parts, based on 100 parts total pigment in the basecoat. Conventional paper coating pigments (e.g., calcium carbonate, clay, titanium dioxide, aluminum tri-hydrate, talc, etc.) can also be combined with the absorbent and deformable pigments to give a balance of desired final properties, manufacturing latitude, and raw material cost. Hence, conventional paper coating pigments are present in an amount of from 0 to 80 parts, based on 100 parts pigment. One embodiment of the invention provides that, conventional paper coating pigments are present in an amount of 35 to 65 parts, based on 100 parts total pigment in the basecoat.

The binder system of the absorbent basecoat is comprised of a combination of (1) any of a number of water-soluble polymers including, but not limited to—starch, polyvinyl alcohol, gelatin, casein, cellulose derivatives, and poly (vinylpyrrolidone); and (2) aqueous dispersions/emulsions of lattices including, but not limited to—styrene-butadiene lattices and modifications and copolymers thereof, acrylics and modifications and copolymers thereof, and vinyl acetate and modifications and copolymers thereof. Acrylic polymers are particularly advantageous, due to their high solids content, excellent binder strength, and good light-fastness properties. Binder is present in an amount from about 1 to about 20 parts, as needed, to balance coating integrity and porosity. In one embodiment of the invention, the binder is present in an amount from about 5 to about 20 parts. The basecoat may also contain other additives, for example, dispersants, optical brighteners, rheology modifiers, leveling agents, defoamers, etc.

In one embodiment of the invention, the basecoat is applied to the substrate in an amount ranging from more-than-0 to about 30 g/m$^2$ per side. In another embodiment of the invention, the basecoat is applied in an amount ranging from about 9 to about 25 g/m$^2$ per side. The solids and viscosity of the basecoat can be adjusted to accommodate a variety of coating application methods. In one embodiment, the solids content can be as high as 50 to 55% while maintaining a workable viscosity. A basecoat, thus prepared, can be applied with high speed coating equipment such as the blade coater, rod coater, roll coater, and metered size-press. Other means of coating which may be used include, but are not limited to, air knife, gravure, spray coater, slot-dye, curtain coater, and casting coating methods. The basecoated substrate can optionally be calendered, and/or receive other surface treatments prior to application of the topcoat.

EXAMPLE 1

Gloss Promoting Basecoat A

Example 1 illustrates the composition of a basecoat formulation according to the invention as follows:

| | |
|---|---|
| Alcoa Hydralcoat2 (alumina tri-hydrate) | 54.5 parts dry |
| Grace-Davison W-300 (silica) | 36.4 parts dry |
| Rohm&Haas BC-643 (binder coated hollow-sphere plastic pigment) | 9.1 parts dry |
| Alco Alcosperse 149P (dispersant) | 0.9 parts as received |
| Rohm&Haas NW1845K (acrylic polymer) | 8.2 parts dry |
| Clariant Cartacoat LP (PEG) | 6.8 parts dry |
| Solvox Special 647 (defoamer) | as needed |

The solids content of this coating is 50%, with a stable Brookfield viscosity (100 rpm, spindle 5, at 86 degrees F.) of about 650 cp.

The ink-receptive topcoat layer primarily comprises alumina hydrate, gelatin, and a water-insoluble cationic polymer. Alumina hydrate-provides high surface area and porosity combined with cationic surface sites, making it particularly well-suited for solvent/carrier fluid absorption and dye fixation. The term alumina hydrate, as used herein, includes any of a variety of crystalline and non-crystalline aluminum oxide forms, both hydrous and anhydrous. Fumed and precipitated alumina hydrates have both demonstrated utility in the present invention. Boehmite and pseudo-boehmite forms of alumina hydrate are well-suited for use according to the invention. Water-dispersible forms of these are particularly convenient.

In one embodiment of the invention, the alumina hydrate used for the topcoat layer has a BET surface area in the range from 100 to 260 $m^2/g$, pore volume in the range from 0.1 to 1.1 ml/g, and dispersed particle size in the range from 25 to 300 nm. In another embodiment of the invention, the alumina hydrate used for the topcoat has a BET surface area in the range from 100 to 140 $m^2/g$, pore volume in the range from 0.4 to 1.1 ml/g, and dispersed particle size in the range from 100 to 200nm. BET surface area refers to the measure of surface area using the gas adsorption method of Brown, Emmet and Teller. An alumina hydrate having these characteristics provides an appropriate balance of coating pore structure and gloss. Other pigments, both organic and inorganic, may optionally be combined with the alumina hydrate, so as to modify product performance and material cost.

In still another embodiment of the invention the alumina hydrate of the topcoat layer is in the form of alumina hydrate surface-coated or surface-enriched particles, such as alumina hydrate-coated silica particles, as known in the art. The alumina hydrate of the topcoat formulation may consist entirely of alumina-hydrate surface-enriched particles, entirely of alumina hydrate particles or consist of a mix of such alumina hydrate surface-enriched particles and alumina hydrate particles. The BET surface area and pore volume of alumina hydrate surface enhanced pigments may be within the same ranges as described for pure alumina hydrate particles above.

In one embodiment of the invention, alumina hydrate based pigment particles, whether pure alumina hydrate particles, alumina hydrate surface-enriched particles or a mixture thereof, account for at least 40 parts, based on 100 total parts pigment in the topcoat formulation. In another embodiment of the invention, the alumina hydrate(s) account for at least 75 parts, based on 100 parts total pigment in the topcoat formulation.

The binder system of the ink-receptive layer is primarily composed of a blend of ultra-low molecular weight (ULMW) gelatin and optionally a water-insoluble cationic polymer. Gelatin is well known to be a water and organic solvent absorbent polymer with cationic sites capable of dye fixation, excellent light-fastness properties, and good glossing character. The inventors have discovered that ULMW gelatin is advantageous in combination with the aforementioned alumina hydrate. First, the ULMW gelatins are cold-water soluble, and solutions of manageable viscosity can be made with solids as high as 50 percent or higher. This greatly increases the manufacturing latitude for the coating operation, as cooking of the binder is not required, the binder/coating does not gel upon cooling, and coating solids can be increased to provide sufficient coat weight application using high-speed coating application methods. Second, the sol-gel stability of the alumina hydrate/gelatin system is improved with decreasing gelatin molecular weight.

Stability of the alumina hydrate dispersion (sol) is particularly sensitive to cationic species. This is particularly true, as the solids of the alumina hydrate dispersion is increased. On the other hand, gelatins are sensitive to metallic ions including aluminum ion and disadvantageously may be gelled by trace amounts of aluminum ion present in or on the alumina hydrate surface or otherwise provided by the alumina hydrate. The solution stability of the alumina/gelatin system decreases rapidly with increasing gelatin molecular weight. Thus, as gelatin molecular weight is increased the alumina/gelatin system viscosity rapidly increases and ultimately gels and/or forms agglomerates. The viscosity build can, of course, be offset to some degree by dilution with water. Due to this incompatibility of alumina hydrate and gelatin, it has not previously been possible to exploit the advantageous properties of both alumina hydrate and gelatin by combining the two materials in the same formulation at high solids.

The present invention obviates the incompatibility between alumina hydrate and gelatin by providing that the gelatin used is of an ultra-low molecular weight form. For example, hydrolyzed gelatin having ultra-low molecular weight may be used in combination with alumina hydrate, according to the invention. Surprisingly, ULMW gelatins, such as hydrolyzed gelatin, which are chemically similar to standard gelatins typically used for inkjet and photographic coatings, are compatible with alumina hydrate in all proportions. By comparison, as the weight averaged molecular weight is increased beyond approximately 10,000 for acid-processed gelatins, or 5,000 for alkali treated gelatins, compatibility decreases rapidly, and dilution of the coating becomes necessary.

FIG. 1 illustrates the effect of gelatin molecular weight on viscosity for an alumina/gelatin system at 41.7 percent solids and 75 degrees F. All of the mixtures contained 100 parts of boehmite alumina with varying amounts of gelatin. The viscosities reported are stable with time and were measured with a Brookfield viscometer using a #5 spindle at 100 rpm. The data set labeled 8426 is for an acid-processed gelatin with a weight averaged molecular weight of 3000, while the data set labeled 8476 is for an acid-processed gelatin with a weight averaged molecular weight of 12000. Both of these gelatins are cold water soluble and were made down at high solids and diluted to 41.7 percent solids prior to addition to the alumina dispersion. Gelatin 8426 could be added in proportions beyond 25 parts per hundred parts alumina, while maintaining a viscosity appropriate for high speed coating application. However, viscosity rapidly increased with the addition of gelatin 8476, becoming inappropriately high for high speed coating application at approximately 1 part per hundred parts alumina.

In one embodiment of the invention, the ULMW gelatin is an acid-processed gelatin with a weight averaged molecular weight (MW) less than 12,000. In another embodiment of the invention, the ULMW gelatin is an acid-processed gelatin with a MW less than about 10,000. In another embodiment of the invention, the ULMW gelatin is an acid-processed gelatin with a MW less than about 6,000. In yet another embodiment of the invention, the ULMW gelatin is an alkali-processed gelatin with a MW less than 5,000.

Bloom value is a measurement of the strength of a gel formed by a 6.66% (6 and ⅔ percent) solution of a gelatin that has been kept in a constant temperature bath at 10° C. for 18 hours. A device called a Texture Analyzer is used to measure the weight, in grams, that is required to depress a standard AOAC plunger 4 mm into the gel. Suitable ultra-low molecular weight gelatins according to the present invention include those having a Bloom value of zero or approximately zero. Such gelatins do not gel at room temperature. An ultra-low molecular weight gelatin having a Bloom value of zero or approximately zero is one suitable type of gelatin according to the invention.

These ultra-low molecular weight gelatins retain the dye-fixing properties of conventional gelatin, but binder-strength can be compromised and films formed thereof tend to exhibit cracking. The tendency for cracking increases with decreasing gelatin molecular weight, so that a blend of relatively high molecular weight ULMW gelatin (e.g. MW=12,000) may be combined with relatively low molecular weight ULMW gelatin (e.g. MW=3,000) to balance viscosity with cracking tendency. Also, a co-binder can be used with the ULMW gelatin to provide sufficient coating integrity. Since ULMW gelatins, such as the described hydrolyzed gelatin, are cold water soluble, a cross-linker or hardening agent may also be required to improve water-fastness. According to the invention, ULMW gelatin is present in an amount ranging from more-than-zero to about 30 parts, based on 100 parts pigment. In one embodiment of the invention, the ULMW gelatin is present in an amount ranging from more-than-zero to about 15 parts, based on 100 parts pigment.

The water-insoluble cationic polymer in the ink-receptive layer of the present invention may comprise one or more types of a hydrophobic monomer, a cationic moiety capable of dye fixation, and hydroxyl and/or carboxyl groups capable of cross-linking with moieties in the ULMW gelatin and other water-soluble additives. The hydrophobic monomer(s) should be present in sufficient quantity to render the polymer water-insoluble, thus providing a water-resistant, dye-fixing binder. The cationic moiety may be an amine group, for example a quaternary amine group. Further, the composition, molecular weight, and Tg (glass transition temperature) of the water-insoluble polymer are selected to overcome the deficiencies in binding power of the ULMW gelatin, namely surface cracking and poor adhesion to the basecoat and/or substrate. Thus, the water-insoluble cationic binder provides enhanced dye-fixation, water-resistance, basecoat and/or substrate adhesion, and surface durability. Advantageously, the combination of alumina hydrate, ULMW gelatin, and water-insoluble cationic polymer provides a surface that is resistant to scratching, can be written on with a pencil or pen, and maintains dye fixation and coating integrity even after being submerged in water.

Typically, when a printed inkjet sheet is contacted with water, the printed areas begin to bleed into adjacent areas and/or penetrate further into the sheet. The result is a reduction in ink density within the original image area. Table 1 illustrates the improvement in water-fastness achieved for the microporous ink-receptive coating described herein, with the addition of a particular water-insoluble cationic polymer. The change in ink density, following submersion of the printed sheets in water for 1, 5, 30, and 60 seconds is reported. The addition of the water-insoluble cationic polymer results in a significant reduction of the ink density losses for magenta, yellow, and black inks printed with an HP970 cxi inkjet printer. Note that the cyan density actually increases significantly upon submersion when the water-insoluble cationic polymer is present. This is caused by an increase in size of the individual ink dots (i.e.—dot gain). However, unlike the sample with the all gelatin binder system, no ink bleed occurred into adjacent areas for the cyan. The loss in density associated with bleeding which occurred for the all gelatin binder sample, was apparently offset by simultaneous dot gain—resulting in very little change in ink density. Thus, despite the apparent contradiction, even the cyan ink exhibited greater

TABLE 1

Submersion Waterfastness Test Results

| Submersion | % Ink Density Change after Submersion | | | |
|---|---|---|---|---|
| Time (sec) | cyan | magenta | yellow | black |
| Microporous Ink Receptive Coating with 8 parts gelatin | | | | |
| 1 | 1.7 | −8.8 | −1.8 | −1.5 |
| 5 | 1.7 | −12.0 | −3.6 | −2.0 |
| 30 | 0.8 | −21.8 | −19.8 | −8.0 |
| 60 | −0.8 | −23.2 | −24.3 | −11.8 |
| Same coating with 4 parts gelatin and 4 parts Interpolymer HX31−65 | | | | |
| 1 | 4.8 | 0.0 | 2.8 | 1.7 |
| 5 | 5.6 | 0.5 | −1.9 | −0.6 |
| 30 | 7.2 | 0.0 | −1.9 | 1.7 |
| 60 | 8.9 | −7.5 | −3.8 | −5.0 |

water-fastness when the water-insoluble cationic polymer was present. Similar qualitative response was verified for other printers and ink sets and by other water-fastness test methods (e.g. a drip test method).

In one embodiment of the invention, the water-insoluble cationic polymer is present in an amount ranging from more-than-zero to about 20 parts, per 100 parts pigment in the ink-receptive layer formulation. In another embodiment of the invention, the water-insoluble cationic polymer is present in an amount ranging from more-than-zero to about 12 parts, per 100 parts pigment in the ink-receptive layer formulation.

In another embodiment of the invention, the combination of ULMW gelatin and water-insoluble polymer, each being present in the topcoat formulation in an amount of more-than-zero parts, is not to exceed 30 parts in total, based on 100 parts pigment in the ink-receptive layer formulation. The water-insoluble cationic polymer may comprise a combination of compounds, each being a water-insoluble cationic polymer according to the invention.

Addition of the water-insoluble cationic polymer to the ULMW gelatin/alumina hydrate matrix vastly improves the water resistance and surface durability of the coating. Alternatively, water resistance and coating durability can be improved by cross-linking the ULMW gelatin with itself. Improvement can also be achieved by cross-linking the ULMW gelatin with the water-insoluble cationic polymer. Suitable cross-linkers include, but are not limited to glyoxals, gelatin hardeners, epoxides, and metallic salts.

Optionally, PVP and copolymers thereof or other water-soluble binders, can be combined with the binders discussed above. PVP is a well-known inkjet binder/fixative and is also frequently used as a dispersing aid or protective colloid. In one embodiment of the invention, PVP is added to provide enhanced print quality as well as to modify and stabilize the coating viscosity. Addition of as little as 1 part low molecular weight PVP, based on 100 parts total pigment in the formulation, shows significant viscosity reduction and provides a stable dispersion viscosity for several days. Due to PVP's well-documented deficiency in light-fastness, care should be taken to limit PVP addition to small quantities. Other additives may include, but are not limited to, dispersants, wetting agents, leveling aides, viscosity modifiers, defoamers, colorants, biocides, optical brighteners, coalescing aides, plasticizers, charge compatibilizers, UV absorbers, antioxidants, and antiozonants.

In one embodiment, the ink-receptive layer is applied in an amount ranging from about 4 to about 20 g/m$^2$ per side. In a still further embodiment, the ink-receptive layer is applied in an amount ranging from about 6 to about 15 g/m$^2$. The ink-receptive layer can be applied with high speed coating equipment such as the blade coater, rod coater, roll coater, and metered size-press. Alternatively, other means of coating may be employed, such as, but not limited to, air knife, gravure, spray coater, slot-dye, curtain coater, and casting coating methods. The ink-receptive layer can optionally be calendered, and/or receive other surface treatment to modify specular and topographic properties. For example, the ink-receptive layer can be applied by a high speed coating method and the coated product can then be passed through one or more heated roll nips to provide a surface of superior gloss.

The inkjet image receiving layer constructed as described offers near-photo printed image quality, instant dry images, wet coating integrity, a high degree of water-fastness, surface durability, and is write-able with both pen and pencil. Thus, the invention provides a very high quality inkjet recording medium that is capable of being manufactured on high speed coating equipment.

EXAMPLE 2

Example 2 illustrates the composition of an ink-receptive coating formulation according to the invention as follows:

| | |
|---|---|
| Sasol 14N4-80 (Alumina hydrate) | 100 parts dry |
| Kind & Knox 8426 (ULMW hydrolyzed gelatin) | 4 parts dry |
| Interpolymer HX31-65 (water-insoluble cationic polymer) | 4 parts dry |
| BASF K-17 (PVP) | 1 part dry |
| Rhodia Igepal CA 897 (surfactant) | 1 part dry |
| Nalco 99PG028 (defoamer) | as needed |

The solids content of this coating is 42%, with a stable Brookfield viscosity (100 rpm, spindle 5, 86 degrees F.) of about 700 cp.

As a further example, the absorbent basecoat formulation of Example 1 and the ink-receptive coating formulation of Example 2 may be employed together to construct a printing medium comprising a substrate, a basecoat layer according to Example 1 and an ink-receptive topcoat layer according to Example 2. In a variation of this example, the printing medium has a two-layer construction comprising the substrate, the basecoat layer directly coated onto at least one side of the substrate and the topcoat layer directly coated onto one or both of the previously basecoated layer(s).

Gloss-Over-Matte Printing Media of the Invention

The present inventors have also discovered that inkjet printing media having advantageous characteristics are also obtained by applying the above-described topcoat formulations over alternative basecoats with greater ink vehicle absorption capacity and absorption rate, for example, those more closely resembling commercial matte inkjet coatings. Typical of such formulations are paper coatings composed primarily of absorptive pigments, e.g., precipitated silica and silica gel and water-soluble binder, e.g., PVOH, starch, gelatin and PVP.

The basecoat formulations used in the high-gloss embodiments of the invention represent the optimal compromise between absorption of ink vehicle and glossability, providing sufficient ink vehicle absorption while promoting a high level of gloss. A more absorbent, i.e., porous basecoat layer will, in general, produce a lower finished gloss. However, the increased absorption rate and/or absorption capacity obtained by using a more absorbent basecoat, versus that of the high-gloss embodiments, provides that less coat weight can be used to provide the same amount of absorption. Therefore, a basecoat with greater absorption can be applied at lower coat weight and, once top-coated with the ink-receptive topcoat formulation, achieve the same level of print fidelity as the high-gloss embodiments, albeit at a reduced gloss level. An important factor in this trade-off is that as the coat weight requirement for the basecoat is reduced, the ease of manufacturing such a double-layer product in-line on a paper machine may be increased.

The present inventors have discovered that the double-layer system described herein is amenable to the trade-offs discussed above between basecoat absorption, gloss, and basecoat coat weight required to maintain print fidelity. The basecoats of the high-gloss embodiments are representative of the glossy end of the spectrum and require relatively high basecoat coat weight to provide sufficient absorption. The present inventors have discovered that the use of alternative basecoats having significantly greater absorption rates provide the same print quality, once top-coated, as the high-gloss basecoats disclosed herein, but at a greatly reduced basecoat coat weight, for example, at one half the basecoat weight required using the high-gloss embodiment basecoat formulations. Gloss is significantly reduced in comparison to the high-gloss embodiments but, nevertheless, remains at a desirable level. The following examples are representative of basecoat formulations having porosity suitable for this embodiment of the invention. Such basecoat formulations are referred to as "matte printable" basecoat formulations herein.

An additional feature of this matte printable basecoat system is that it produces a matte-finish inkjet printable surface in and of itself. This provides the manufacturer with a variety of options including the ability to produce a C2S (coated on 2 sides) matte-finish inkjet print media by applying a matte-printable basecoat, such as Basecoat B below, on a substrate and optionally converting one or both sides to glossy inkjet media by application of the microporous ink-receptive glossy topcoat formulation. This is particularly useful in applications where the desire is to manufacture inkjet paper, with in-line coating equipment, having one glossy coated inkjet surface and one matte coated inkjet surface.

The inventors have developed a high solids, matte-finish inkjet printable coating formulation that is amenable to high speed coating operation. In addition to providing an economical high quality inkjet printing surface, the same coating performs exceptionally well as a basecoat for the above described glossy microporous ink receptive coating. Said matte-finish inkjet printable coating formulation comprises silica, specialty high surface area calcium carbonate, conventional paper coating pigments, and binder. The silica may be precipitated or gel-type silica. The specialty high surface area calcium carbonate includes those with a BET surface area of at least 50 $m^2/g$. Conventional paper coating pigments include, but are not limited to, precipitated calcium carbonate, ground calcium carbonate, clay, aluminum tri-hydrate (ATH), titanium dioxide, etc.

According to the invention, silica is present in the matte-finish inkjet printable coating formulation in an amount of 30 to 60 parts, per hundred parts total pigment. Specialty high surface area calcium carbonate is present in an amount of 20 to 50 parts, per hundred parts total pigment. Conventional paper coating pigments are present in an amount of 0 to 25 parts. The silica and high surface area carbonate comprise the "active" portion of the pigment system providing ink vehicle absorption and dye fixation, while the conventional pigments facilitate adjustment of solids and rheology for high speed coating application methods and reduce overall cost.

In another embodiment of the invention, silica is present in the matte inkjet printable coating formulation in an amount of 40 to 50 parts, per hundred parts total pigment. Specialty high surface area calcium carbonate is present in an amount of 30 to 40 parts, per hundred parts total pigment. Conventional paper coating pigments are present in an amount of 10 to 20 parts. A further embodiment of the invention provides that aluminum tri-hydrate comprises at least a portion of the conventional coating pigment composition.

The binder system of the matte-finish, inkjet printable coating formulation is comprised of a combination of (1) any of a number of water-soluble polymers including, but not limited to—starch, polyvinyl alcohol, gelatin, casein, cellulose derivatives, and poly (vinylpyrrolidone); and (2) aqueous dispersions/emulsions of lattices including, but not limited to—styrene-butadiene lattices and modifications and copolymers thereof, acrylics and modifications and copolymers thereof, and vinyl acetate and modifications and copolymers thereof. Binder is present in an amount of about 10 to about 30 parts, as needed, to balance print quality, coating integrity, and porosity. The matte inkjet printable coating may also contain other additives, including but not limited to, dye mordants/fixatives, dispersants, optical brighteners, rheology modifiers, leveling agents, defoamers, etc.

A matte-finish, inkjet printable coating formulated in such a manner can have coating solids in excess of 35%, while maintaining a Brookfield viscosity (100 rpm, spindle #5) in the range of 300 to 1800 centipoise. Thus, it is possible to simultaneously achieve high-solids, runnability using high-speed coating methods, and suitable performance characteristics for: a) producing a commercial matte-finish inkjet recording medium, b) providing the absorbent basecoat for the gloss-over-matte embodiments described herein, and/or c) providing both these functions on a portion of the same product.

EXAMPLE 3

Matte Printable Basecoat B

Example 3 illustrates the composition of a basecoat suitable for the gloss-over-matte embodiment, according to the inventive matte-finish, inkjet printable coating formulation described above. The solids content of this coating is 37% with a stable Brookfield (100 rpm, spindle 5) viscosity of about 1200 cp.

| | |
|---|---|
| Alcoa Hydralcoat7 (alumina tri-hydrate) | 19.5 parts |
| Grace Davison W300 (silica gel) | 42.5 parts |
| SMI Jetcoat 30 (specialty PCC) | 38 parts |
| Clariant Mowiol 23-88 (PVOH) | 4 parts |
| Cargil 39D (starch) | 2 parts |
| Air Products 426 (vinyl acetate-ethylene, VAE) | 8 parts |
| BASF Luviscol K-17 (PVP) | 2 parts |
| Nalco Nalkat 2020 (polyDADMAC) | 2 parts |
| Nalco FM 1223 (defoamer) | as needed |

Application of 9 $g/m^2$ Basecoat B, followed by a topcoat of 10 $g/m^2$ with the microporous ink-receptive coating described in Example 2, gives equal inkjet print quality compared to samples made with 18 $g/m^2$ Basecoat A, followed by 10 $g/m^2$ of topcoat. However, the 60- and 75-degree glosses are reduced by approximately 3 to 5 points at equal calender conditions.

The "specialty PCC" as included in the above example is a finely-divided precipitated calcium carbonate product with a surface area of 80 m2/g and particle size of 0.02 to 0.03$\mu$m, according to product literature from Specialty Minerals, Inc.

Other types of basecoat formulations suitable for the matte-over-gloss embodiments of the present invention include, but are not limited to, those disclosed in International Publication No. WO 01/45956 A1, which is hereby incorporated by reference in its entirety. These formulations comprise (a) a major portion of specialty forms of precipitated calcium carbonate ("PCC") pigment, (b) a minor proportion of gel-type silica and (c) a binder. Accordingly, these other suitable basecoat formulations include the compositions wherein the gel type silica is present in an amount of 15 to 30%, and in a more specific embodiment from 20 to 30%, of the total dry weight of silica and PCC. A proportion of specialty PCC referred to above can be substituted by another PCC coating pigment not as specified above, or by a finely-ground natural calcium carbonate pigment (GCC). The amount of this other PCC or GCC which can be used depends on the nature of the product concerned, but typically is up to about 25 to 30% of the total calcium carbonate present. The binder used in these matte printable basecoat formulations can be a conventional hydrophilic paper coating binder or may also be a polyvinyl alcohol (PVA), for example a medium molecular weight PVA having a degree of hydrolysis of about 88%. The PVA can, for example, also be used together with polyvinyl pyrrolidone binder (PVP), in a dry weight ratio of about 60:40 to about 80:20, or, in a more specific embodiment, about 70:30. A proportion of polydiallyldimethylammonium chloride (polyDADMAC) or other water fastness agent can also be present to impart additional water-fastness to the printed image.

Commercially available matte inkjet products provide further examples of a suitably basecoated substrate for the reduced-gloss embodiment of the present invention. HP Premium Inkjet Coated Paper and Epson Photo Quality Inkjet Paper, two high quality matte inkjet products, were coated with 10 $g/m^2$ of the microporous ink-receptive coating described in Example 2 and calendered. These samples also provided excellent print quality, albeit at reduced gloss, compared to those made with Basecoat A. Thus, many matte-finish inkjet coating formulations are suitable for the "gloss-over-matte" invention described herein. However, high solids coatings, such as that of Example 3 are particularly amenable to high-speed on-line coating operations.

It should be understood that all of the examples presented herein are meant to be illustrative of the invention and not limiting of its scope. Accordingly the scope of the invention is to be determined in connection with the accompanying claims and their equivalents.

We claim:

1. An inkjet recording medium comprising:

a microporous ink-receptive layer comprising:

alumina hydrate based pigment particles selected from the group consisting of: alumina hydrate particles, alumina hydrate enriched silica particles, alumina hydrate surface-enriched particles, and mixtures thereof; and ultra-low molecular weight gelatin having no tendency for gelation at room temperature selected from the group consisting of: acid-processed gelatin having a weight averaged molecular weight of no greater than 12,000; alkali-processed gelatin having a weight averaged molecular weight of less than 5,000; and mixtures thereof; and a substrate.

2. The inkjet recording medium of claim 1, wherein the microporous ink-receptive layer further comprises at least one co-binder.

3. The inkjet recording medium of claim 2, wherein at least one co-binder is a water-insoluble polymer.

4. The inkjet recording medium of claim 3, wherein the water-insoluble polymer is cationic.

5. The inkjet recording medium of claim 1, wherein the ultra-low molecular weight gelatin is at least partially cross-linked to itself.

6. The inkjet recording medium according to claim 2, wherein the ultra-low molecular weight gelatin is at least partially cross-linked to itself or to the co-binder(s).

7. The inkjet recording medium according to claim 2, wherein at least one co-binder is water-soluble.

8. The inkjet recording medium of claim 7, wherein the at least one water-soluble binder comprises PVP or copolymers of PVP.

9. The inkjet recording medium according to claim 1, wherein the ultra-low molecular weight gelatin has a number averaged molecular weight of less than about 6,000.

10. The inkjet recording medium according to claim 1, wherein the ultra-low molecular weight gelatin is acid-processed gelatin having a weight averaged molecular weight of not greater than 10,000.

11. The inkjet recording medium according to claim 10, wherein the ultra-low molecular weight gelatin is acid-processed gelatin having a weight averaged molecular weight of not greater than about 6,000.

12. The inkjet recording medium according to claim 1, wherein the gelatin is of sufficiently low molecular weight to prevent alumina hydrate induced gelling of the gelatin by the alumina hydrate.

13. The inkjet recording medium according to claim 1, further comprising at least one coating layer underlying the ink-receptive layer.

14. The inkjet recording medium according to claim 13, wherein the underlying coating layer comprises absorbent pigments.

15. The inkjet recording medium according to claim 14, wherein the underlying coating layer further comprises deformable particles.

16. The inkjet recording medium according to claim 15, wherein the deformable particles are polymeric pigments.

17. The inkjet recording medium according to claim 16, wherein the deformable particles have a substantially adhesive outer surface.

18. The inkjet recording medium according to claim 16, wherein the deformable particles are hollow or have-substantial internal void volume.

19. The inkjet recording medium according to claim 18, wherein the deformable particles have a substantially adhesive outer surface.

20. The inkjet recording medium according to claim 14, wherein the underlying layer further comprises conventional paper coating pigments.

21. The inkjet recording medium according to claim 20, wherein the underlying layer further comprises deformable particles.

22. The inkjet recording medium according to claim 21, wherein the deformable particles are polymeric pigments.

23. The inkjet recording medium according to claim 22, wherein the deformable particles have a substantially adhesive outer surface.

24. The inkjet recording medium according to claim 22, wherein the deformable particles are hollow or have substantial internal void volume.

25. The inkjet recording medium according to claim 24, wherein the deformable particles have a substantially adhesive outer surface.

26. The inkjet recording medium according to claim 13, wherein the ultra-low molecular weight gelatin has Bloom value of zero or approximately zero.

27. A substrate coated on at least one side with an absorbent inkjet basecoat layer formulation, the formulation comprising:

binder;

absorbent pigment in an amount from greater-than-zero to less-than-100 parts based on 100 parts total pigment by dry weight in the basecoat formulation;

deformable polymeric pigment in an amount of greater-than-zeco to 50 parts based on 100 parts total pigment by dry weight in the basecoat formulation; and conventional paper coating pigments in an amount of 0 to 80 parts based on 100 parts total pigment by dry weight in the basecoat formulation.

28. The substrate according to claim 27, wherein the substrate is coated in an amount of greater-than-zero to about 30 $g/m^2$ per coated side.

29. The substrate according to claim 28, wherein the substrate is coated in an amount of about 9 to about 25 $g/m^2$ per coated side.

30. The inkjet printable media according to claim 1, wherein the microporous ink-receptive layer is topcoated above an absorbent basecoat layer.

31. The inkjet printable media according to claim 1, wherein the microporous ink-receptive layer is topcoated above an absorbent basecoat layer formulation comprising:

binder;

absorbent pigment in an amount from greater-than-zero to less-than-100 parts based on 100 parts total pigment by dry weight in the basecoat formulation;

deformable polymeric pigment in an amount of 0 to 50 parts based on 100 parts total pigment by dry weight in the basecoat formulation; and conventional paper coating pigments in an amount of 0 to 80 parts based on 100 parts total pigment by dry weight in the basecoat foundation.

32. The inkjet printable media according to claim 1, wherein the microporous ink-receptive layer is applied to the substrate in an amount of about 4 to about 20 g/m$^2$ per coated side.

33. The inkjet printable media according to claim 30, wherein the microporous ink-receptive layer is applied to the substrate in an amount of about 4 to about 20 g/m$^2$ per coated side.

34. A printing paper prepared according to a method comprising the sequential steps of:

(a) applying a basecoat layer of a paper coating formulation to an uncoated substrate or to a previously coated substrate, wherein the basecoat layer paper coating formulation comprises deformable particles;

(b) applying a topcoat layer of a paper coating formulation above the layer applied in step (a); and (c) calendering the paper.

35. A printing paper prepared according to a method comprising the sequential steps of:

(a) applying a basecoat layer of a paper coating formulation to an uncoated substrate or to a previously coated substrate, wherein the basecoat layer paper coating formulation comprises doformable particles;

b) calendering the paper; and (c) applying a topcoat layer of a paper coating formulation above the layer applied in step (a).

36. A printing paper prepared according to a method comprising the sequential steps of:

(a) applying a basecoat layer of a paper coating formulation to an uncoated substrate or to a previously coated substrate, wherein the basecoat layer paper coating formulation comprises deformable particles;

(b) applying a topcoat layer of a paper coating formulation above the layer applied in step (a); and (c) calendering the paper via hot soft-nip calendaring.

37. The inkjet recording medium according to claim 13, wherein the underlying coating layer is a matte-finish, inkjet printable coating.

38. The inkjet recording medium according to claim 37, wherein the matte-finish, inkjet printable coating comprises:

binder;

precipitated or gel-type silica in an amount of 30 to 60 parts, based on 100 parts total pigment by dry weight in the matte inkjet printable coating;

specialty high surface area calcium carbonate in an amount of 20 to 50 parts, based on 100 parts total pigment by dry weight in the matte inkjet printable coating; and conventional paper coating pigments in an amount of 0 to 25 parts, based on 100 parts total pigment by dry weight in the matte inkjet printable coating.

39. The inkjet recording medium according to claim 38, wherein the precipitated or gel-type silica is present in an amount of 40 to 50 parts; the specialty high surface area calcium carbonate is present in an amount of 30 to 40 parts; and conventional paper coating pigments are present in an amount of 10 to 20 parts, all based on 100 parts total pigment by dry weight in the matte inkjet printable coating.

40. The inkjet recording medium according to claim 38, wherein the conventional paper pigment composition comprises aluminum tri-hydrate.

41. The inkjet recording medium according to claim 38, wherein the matte-finish, inkjet printable coating formulation has a Brookfield viscosity in the range of 300 to 1800 centipoise, measured at 100 rpm with spindle #5.

42. The inkjet recording medium according to claim 41, wherein matte-finish, inkjet printable coating formulation has a solids content of greater than 35%.

43. An inkjet printing medium comprising:

a substrate;

a porous, matte-finish, inkjet printable coating coated on at least one side of the substrate; and a glossy microporous ink-receptive topcoat layer formulation coated over at least a portion of the porous, matte-finish inkjet printable coating on at least one of the sides on which the porous, matte-finish, inkjet printable coating is coated, wherein the topcoat layer formulation comprises:

alumina hydrate based pigment particles selected from the group consisting of: alumina hydrate particles, alumina hydrate enriched silica particles, alumina hydrate surface-enriched particles, and mixtures thereof; and ultra-low molecular weight gelatin having no tendency for gelation at room temperature selected from the group consisting of: acid-processed gelatin having a weight averaged molecular weight of no greater than 12,000; alkali-processed gelatin having a weight averaged molecular weight of less than about 5,000; and mixtures thereof;

and optionally a water-insoluble cationic polymer.

44. An inkjet printing medium comprising.

a substrate;

a porous, matte-finish, inkjet printable coating coated on both sides of the substrate; and a glossy microporous ink-receptive topcoat layer formulation coated over the porous, matte-finish inkjet printable coating on only one of tho aides on which the porous, matte-finish, inkjet printable coating is coated, so that one side of the inkjet printing medium has an inkjet printable matte-finish and the other side of the inkjet printing medium has an inkjet printable glossy-finish, wherein the topcoat layer formulation comprises:

alumina hydrate based pigment particles selected from the group consisting of: alumina hydrate particles, alumina hydrate enriched silica particles, alumina hydrate surface-enriched particles, and mixtures thereof; and ultra-low molecular weight gelatin having no tendency for gelation at room temperature selected from the group consisting of: acid-processed gelatin having a weight averaged molecular weight of no greater than 12,000; alkali-processed gelatin having a weight averaged molecular weight of less than about 5,000; and mixtures thereof; and optionally a water-insoluble cationic polymer.

45. The inkjet recording medium according to claim 1, wherein the ultra-low molecular weight gelatin has a Bloom value of zero.

46. The inkjet recording medium according to claim 13, wherein the ultra-low molecular weight gelatin has a Bloom value of zero.

* * * * *

UNITED STATES PATENT AND TRADEMARK OFFICE

CERTIFICATE OF CORRECTION

PATENT NO. : 6,979,481 B2 
DATED : December 27, 2005
INVENTOR(S) : Gaynor et al.

It is certified that error appears in the above-identified patent and that said Letters Patent is hereby corrected as shown below:

Tilte page,
Item [56], References Cited, U.S. PATENT DOCUMENTS,
add -- US-2003/0118792 A1 6/2003 Franceschini et al. 428/195 --.

Column 16,
Line 7, delete the hyphen after "have".
Lines 30-31, "has Bloom value of zero or approximately zero" should read -- has a Bloom value of approximately zero --.
Line 40, "zeco" should read -- zero --.
Line 67, "foundation" should read -- formulation --.

Column 17,
Line 24, "doformable" should read -- deformable --.

Signed and Sealed this

Twenty-first Day of March, 2006

JON W. DUDAS
*Director of the United States Patent and Trademark Office*